US005228764A

United States Patent [19]

Cherry et al.

[11] Patent Number: 5,228,764

[45] Date of Patent: Jul. 20, 1993

[54] REFRIGERATOR SHELF ASSEMBLY

[75] Inventors: David N. Cherry; John A. Sedovic; William D. Irish, all of Louisville, Ky.

[73] Assignee: General Electric Company, Louisville, Ky.

[21] Appl. No.: 926,994

[22] Filed: Aug. 10, 1992

[51] Int. Cl.[5] ..... F25D 11/00

[52] U.S. Cl. ..... 312/408; 211/153; 248/243

[58] Field of Search ..... 312/408, 404, 128, 126; 211/153, 134, 187, 90; 108/153, 108; 248/243, 250, 205.3

[56] References Cited

U.S. PATENT DOCUMENTS

| | | | |
|---|---|---|---|
| 1,094,996 | 4/1914 | Jacoway | 312/126 |
| 2,208,237 | 7/1940 | Williams et al. | 211/134 |
| 3,295,474 | 1/1967 | Ornstein | 248/205.3 |
| 4,429,850 | 2/1984 | Weber et al. | 248/250 |
| 4,733,843 | 3/1988 | Bessinger | 248/250 |
| 4,752,010 | 6/1988 | Holztrager | 211/90 |
| 4,886,236 | 12/1989 | Randall | 248/250 |
| 4,923,260 | 5/1990 | Poulsen | 312/408 |
| 4,936,641 | 6/1990 | Bussan et al. | 312/408 |
| 4,946,121 | 8/1990 | Troke | 248/205.3 |

FOREIGN PATENT DOCUMENTS

| | | | |
|---|---|---|---|
| 1025018 | 1/1965 | United Kingdom | 211/187 |
| 2239595 | 7/1991 | United Kingdom | 211/13 |

*Primary Examiner*—Kenneth J. Dorner
*Assistant Examiner*—Janet M. Long
*Attorney, Agent, or Firm*—Radford M. Reams; H. Neil Houser

[57] ABSTRACT

A household refrigerator shelf assembly includes an unitary support structure having a rear and spaced apart side walls with a horizontally oriented channel extending around the periphery of the structure. A high tempered, high strength sheet is mounted in the channel with adhesive positioned between the sheet and the support structure. The side walls extend along only the rear portion of sides of the glass sheet and bosses are formed in the channel to assure room for an effective amount of adhesive.

10 Claims, 3 Drawing Sheets

REFRIGERATOR SHELF ASSEMBLY

BACKGROUND OF THE INVENTION

This invention relates to refrigerator shelf assemblies and, more particularly, to such assemblies which employ the strength of modern high tempered, high strength glass to provide a simple, easily cleaned and unobtrusive shelf assembly.

The food storage compartments of modern refrigerators often include several cantilevered shelves which are adjustably mounted in vertically spaced apart relationship within the compartment to support various items stored in the compartment. The use of glass shelves enhances the visibility within the compartment and simplifies cleaning the shelves. However, the support assemblies for these shelves still impede optimum visibility and offer numerous nooks and crannies which are difficult to clean.

By this invention there is provided an improved shelf assembly which is easy to assemble, provides enhanced visibility in the refrigerator and is easy to clean.

SUMMARY OF THE INVENTION

There is provided a refrigerator shelf assembly including an elongated rear support member and a pair of side support members secured to the ends of the rear member to form an unitary support structure. The support members are formed with a channel which extends horizontally around the entire inner surface of the support structure. A sheet of high tempered, high strength glass is positioned with only the rear portions of its side edges and its rear edge received in the channel and adhesive is positioned in the channel between the glass sheet and the support structure to secure the sheet in the channel. Bosses extend into the channel to assure room for an effective amount of adhesive. Conveniently the side members are formed with hooks or other mounting devices to selectively mount the shelf on a mounting structure in the refrigerator compartment.

DESCRIPTION OF THE PREFERRED EMBODIMENTS

Figure 1:
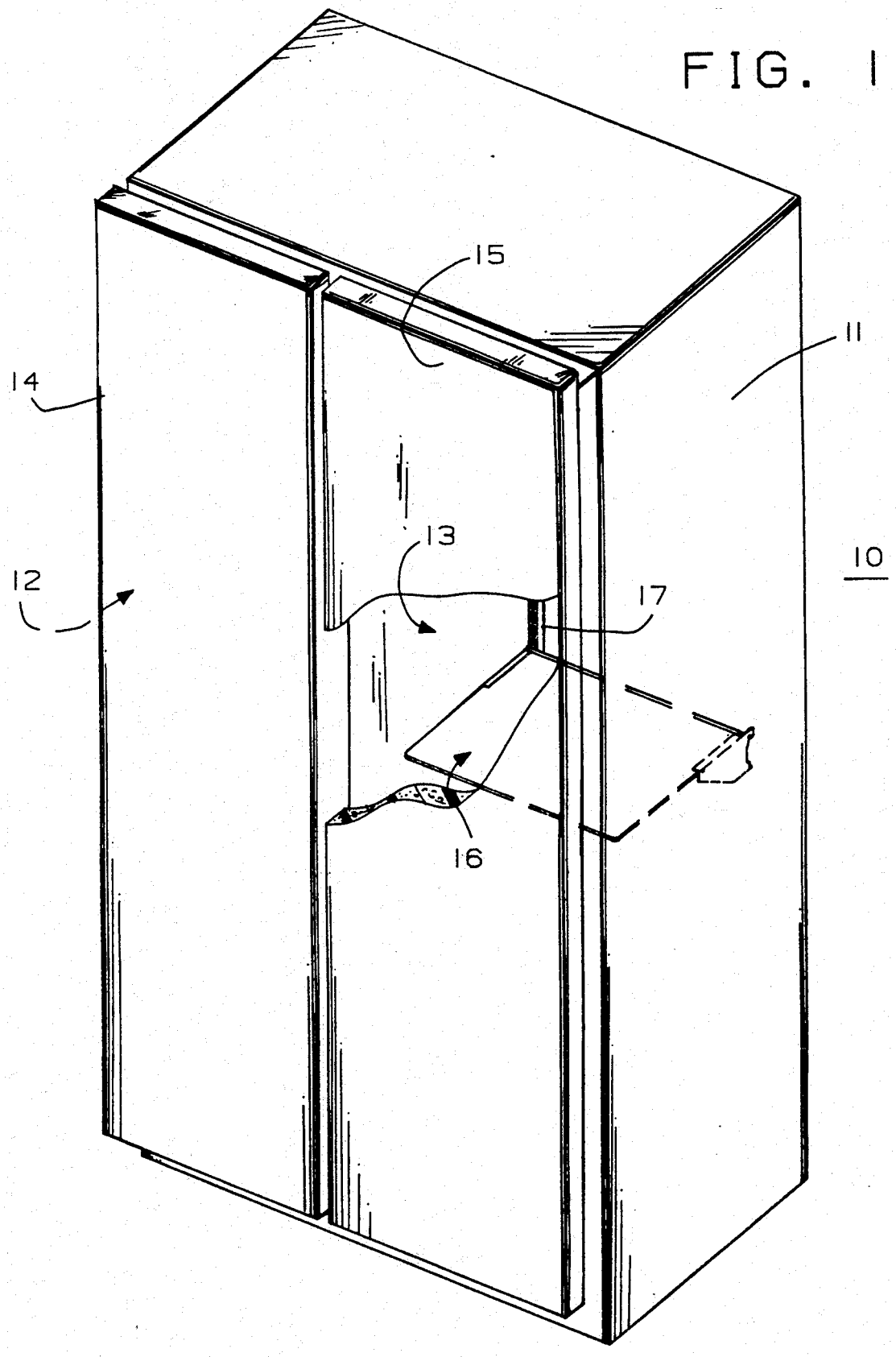
FIG. 1 is a simplified front perspective view of a side-by-side refrigerator with a shelf assembly incorporating one embodiment of the present invention.

Referring particularly to FIG. 1 of the drawings, there is shown a household refrigerator 10 of the side-by-side type; that is the cabinet 11 includes a freezer compartment 12 and a fresh food compartment 13 arranged in a side-by-side relationship. Each of the compartments has a front access opening which is normally closed by hinged doors 14 and 15 respectively. The particular refrigerator structure 10 is shown for illustration purposes only and it will be understood as the description progresses that the present invention is equally useful with other types of refrigerators, such as, for example, top mount refrigerators in which the freezer compartment is positioned above the fresh food compartment. Various operating components of refrigerators, such as the refrigeration system for example, are not involved in the present invention and have been omitted for the sake of simplicity.

Shelves, such as that illustrated at 16, are provided to support various items stored in either the freezer or the fresh food compartment and conveniently mounting means are provided to cooperate with the shelves for vertical adjustable positioning of the shelves in the compartments. One widely used mounting means are ladder tracks attached to extend vertically along the edges of the back walls of the compartments, one such track being shown at 17. The shelf assemblies include hooks which permit the user to selectively mount the shelves to the tracks.

Figure 2:
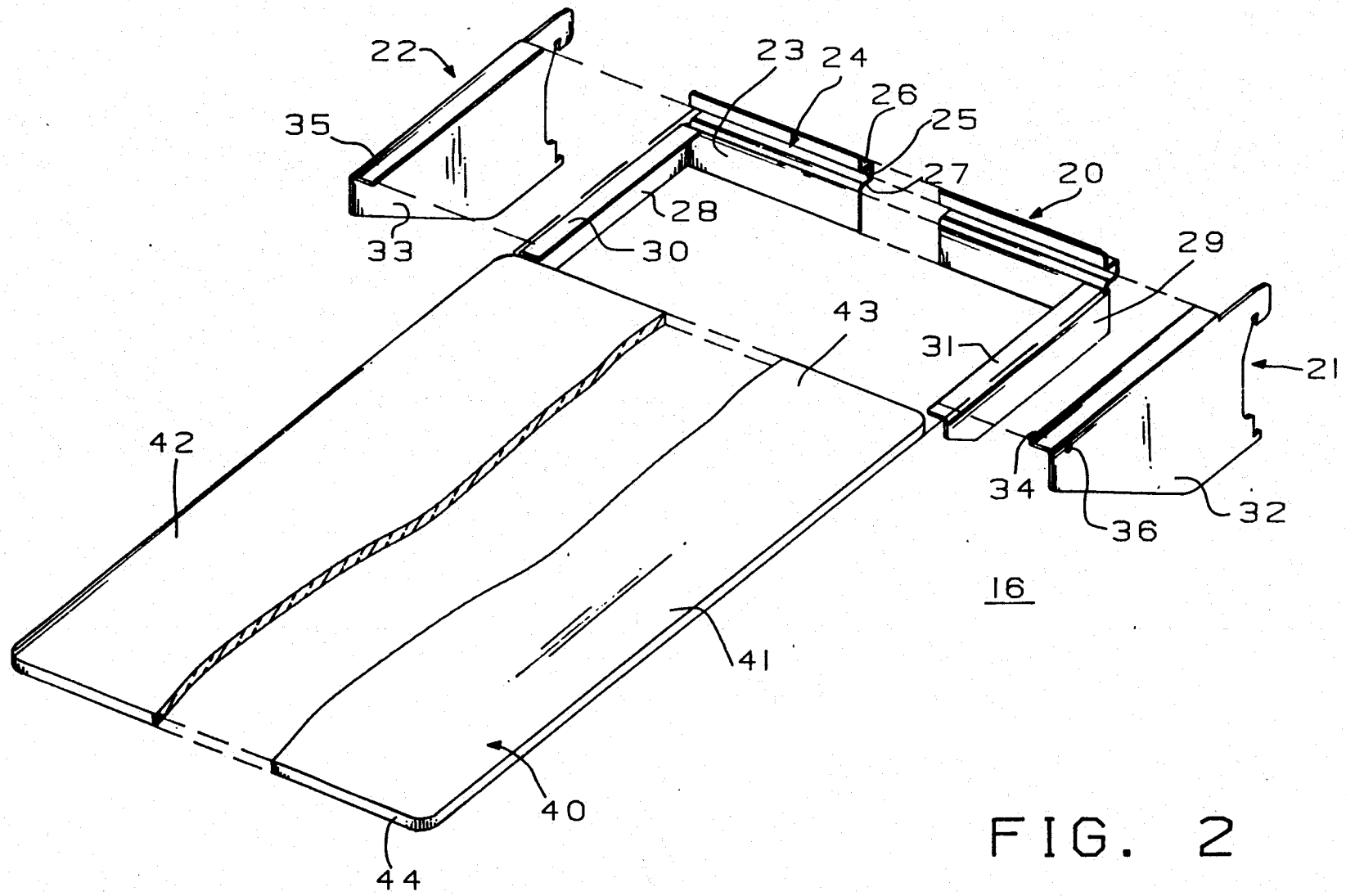
FIG. 2 is an exploded perspective view of the shelf shown in FIG. 1.

Referring now more particularly to FIG. 2, the shelf assembly 16 is illustrated in more detail. The assembly 16 includes a rear support member 20 and side support members 21 and 22 respectively. The rear member 20 is formed with an elongated vertically oriented wall 23 provided with a horizontally extending channel 24. The channel 24 includes a vertical base 25 and spaced apart upper and lower horizontal legs 26 and 27. The distal end portions of the rear member are bent at right angles and extend forwardly from the wall 23 and form arms including vertical wall portions 28 and 29 respectively. The upper portion of each arm is bent at right angles to form inwardly projecting horizontal flanges 30 and 31 respectively. The flanges are vertically aligned with the lower leg 27 of the channel 24.

Figure 3:
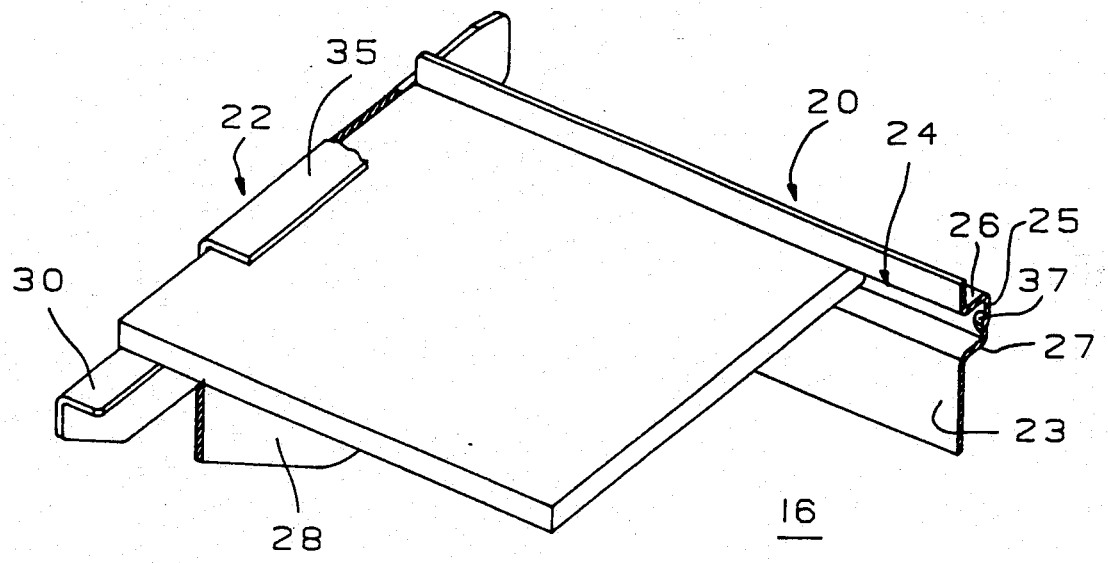
FIG. 3 is a fragmentary perspective view of the shelf assembly shown in FIG. 1.

The side support members 21 and 22 are formed with vertical wall portions 32 and 33 respectively. The upper edges of the wall portions 32 and 33 are bent at right angles to form inwardly projecting horizontal flanges 34 and 35 respectively. The side members 32 and 33 are firmly attached to the arm portions of the rear member 20 to form an unitary structure. Preferably the attachment is accomplished by spot welding wall 32 to wall 29 and wall 33 to wall 28. In any event the side members are attached to the rear member so that the flanges 34 and 35 are aligned with the upper leg 26 of the channel 24. In this way the flanges 30–35 and 31–34 together with the portion of walls 32 and 33 respectively spanning the flanges form extensions of channel 24 along the length of the side support members. Bosses, such as that shown at 36 in wall 32 and at 37 in channel base 25 (see FIG. 3) are formed in the channel 24.

The shelf assembly 16 also includes a sheet 40 of high tempered, high strength glass having parallel spaced apart side edge portions 41 and 42 joined by a rear edge portion 43. One such suitable material is sold by the Hamilton Glass Products component of Gemtron Corporation as High T glass. The side and rear edge portions of sheet 40 are straight and rectilinear. While the front edge portion 44 also is shown as straight it may be provided with other configurations if desired. The sheet 40 has a significant thickness, about one quarter inch in the exemplification embodiment, for strength. The peripheral edge of the sheet 40 preferably is ground and polished.

A suitable adhesive such as RTV silicone is spread over the channel 24, including the side extensions. Then the glass sheet 40 is inserted into the channel 24 until the rear edge portion 43 is fully seated in the portion of channel 24 in rear member 20 and the rear part of the side edge portions 41 and 42 of the sheet 40 are positioned in the side extensions of the channel. Typically glass sheets have fairly wide thickness tolerances. Therefore the channel is made wide enough to provide clearance for the outside limit of glass thickness. The bosses, such as those shown at 36 and 37 assure that the glass sheet does not seat firmly against the base of the channel and thus an amount of adhesive effective to secure the glass sheet in the channel is assured.

The high tempered, high strength glass is sufficiently strong that the side support structures need only come part of the way along the sides of the glass sheet, which enhances the visibility of the assembly. If a more decorative appearance is desired, the sides can be extended. Also while the illustrated embodiment is presently preferred, other forms of support structures are envisioned. For example the rear support member could be a simple rod which ties the side support members together. In that event the side channels could be formed integrally of the side support members, as channel 24 is formed in the illustrative rear support member 20, and there would be no rear channel portion. It will be understood that these and other modifications may be made without departing from the true spirit and scope of the invention.

What is claimed is:

1. In a refrigerator with a food storage compartment, a shelf assembly including:

an elongated rear support member and a pair of spaced apart side support members secured to said rear support member to form an unitary structure;

a horizontally oriented channel having a side portion extending along each said side support members and a rear portion extending along said rear support member;

a sheet of high tempered, high strength glass having its rear edge and the rear portion of each of its side edges received in said channel; and adhesive received in said channel between said support members and said glass sheet to secure said sheet in said channel.

2. A shelf assembly as set forth in claim 1, wherein: said adhesive is RTV silicone.

3. A shelf assembly as set forth in claim 1 wherein:

said rear support member includes a vertical wall formed with said rear portion of said channel projecting rearwardly thereof, said rear channel portion including upper and lower spaced apart horizontal legs;

said rear support member also includes a pair of vertically oriented arms extending forwardly from the opposite ends of said vertical wall, each of said arms including a horizontal flange projecting inwardly in alignment with said lower leg of said rear portion of said channel; and each of said side support members includes a vertically oriented wall with a horizontal flange projecting inwardly thereof, each of said side support members being joined to the corresponding forwardly extending arm of said rear support member with its horizontal flange in alignment with said upper leg of said rear portion of said channel to form said side portions of said channel.

4. A shelf assembly as set forth in claim 3, further including spacer means positioned in said recess to assure space for an effective amount of adhesive between said glass sheet and said support members.

5. For use with a refrigerator including a food compartment having a rear wall with a pair of spaced apart ladder tracks extending upwardly along the rear wall, a shelf assembly including:

a pair of spaced apart side support structures including attachment means for selective mounting to the ladder tracks and a transverse rear cross structure attached at opposite ends to said side structures to form an unitary support structure;

each of said side structures including a horizontally oriented elongated side support channel;

a sheet of high tempered, high strength glass having parallel side edges, the rear portion of each side edge being received in a corresponding side channel; and adhesive received in each side channel between said glass sheet and said side structure to secure said sheet in said channels.

6. A shelf assembly as set forth in claim 5, further including: spacer means in each channel for assuring space for an effective amount of adhesive between said glass sheet and said side structures.

7. A shelf assembly as set forth in claim 6, wherein: said spacer means is in the form of bosses formed in said side structures projecting into said side channels.

8. A shelf assembly as set forth in claim 5, wherein said adhesive is RTV silicone.

9. A shelf structure as set forth in claim 5, wherein: said rear support structure includes a horizontally oriented, elongated rear support channel joining each of said side support channels; said glass sheet includes a rear edge received in said rear channel and adhesive is received in said rear channel between said rear edge of said sheet and said rear support structure.

10. A shelf assembly as set forth in claim 9, further including bosses projecting into each of said support channels for assuring an effective amount of adhesive between said glass sheet and said support structures.

* * * * *